US005314773A

United States Patent [19]

Kubo et al.

[11] Patent Number: 5,314,773

[45] Date of Patent: May 24, 1994

[54] BLACK TONER FOR ELECTROPHOTOGRAPHY

[75] Inventors: Masahiko Kubo, Yao; Akihiro Watanabe, Nara; Takafumi Nagai, Higashiosaka; Hironori Maruyama, Kadoma, all of Japan

[73] Assignee: Mita Industrial Co., Ltd., Osaka, Japan

[21] Appl. No.: 909,564

[22] Filed: Jul. 6, 1992

[30] Foreign Application Priority Data

Jul. 17, 1991 [JP] Japan ..... 3-176496

[51] Int. Cl.[5] ..... G03G 13/01

[52] U.S. Cl. ..... 430/45; 430/54; 430/106; 430/106.6; 430/109; 430/110; 430/124; 430/137; 430/138

[58] Field of Search ..... 430/45, 54, 106, 106.6, 430/109, 110, 124, 137, 138

[56] References Cited

U.S. PATENT DOCUMENTS

| | | | |
|---|---|---|---|
| 3,959,008 | 5/1976 | Warner et al. | 106/307 |
| 4,762,763 | 8/1988 | Nomura et al. | 430/110 |
| 5,087,538 | 2/1992 | Nelson | 430/45 |
| 5,116,711 | 5/1992 | Kobayashi et al. | 430/106 |
| 5,149,610 | 9/1992 | Kobayashi et al. | 430/106 |
| 5,164,275 | 11/1992 | Kobayashi et al. | 430/45 |

FOREIGN PATENT DOCUMENTS

| | | |
|---|---|---|
| 0084693 | 8/1983 | European Pat. Off. . |
| 0429294 | 5/1991 | European Pat. Off. . |
| 1467495 | 3/1977 | United Kingdom . |

OTHER PUBLICATIONS

Pigment Handbook, vol. 1, *Properties and Economics*, John Wiley & Sons, (1973) pp. 709-733.

EPO Search Report mailed Oct. 13, 1992 for EP Application 92306 358.0.

*Primary Examiner*—John Kight, III

*Assistant Examiner*—Shelley A. Dodson

*Attorney, Agent, or Firm*—Renner, Otto, Boisselle & Sklar

[57] ABSTRACT

Black toner for electrophotography used for visualizing an electrostatic latent image formed on an image-holding body is provided which includes a resin binder and carbon black dispersed in the resin binder. The carbon black has a volatile component content of 4% or more, a structure index of 100 or more, and a mean grain size in the range of 20 to 35 nm.

14 Claims, 1 Drawing Sheet

BLACK TONER FOR ELECTROPHOTOGRAPHY

BACKGROUND OF THE INVENTION

1. Field of the Invention:

The present invention relates to black toner for electrophotography used for an image forming apparatus employing so-called electrophotographic technology, especially, an electrostatic printing method, such as an electrostatic copying machine and a laser beam printer. More particularly, it relates to black toner used with color toners such as magenta, cyan, and yellow toners for full color image formation by the electrophotographic technology.

2. Description of the Prior Art:

In the field of electrophotographic technology, especially, in an electrostatic printing method, toner is used for visualizing an electrostatic latent image formed on an image-holding body. This toner is prepared by dispersing a colorant in a resin medium. As the resin medium, resin having a desired detecting property and a binding property, for example, various resins such as styrene resin and polyester resin are used. As the colorant, carbon black and other organic or inorganic color pigments are used.

There has been conducted full color development in recent years. The full color development is conducted in the following manner. First, a multicolor original is subjected to color separation treatment, after which each image is exposed to light. This process is repeated by the use of color toners of magenta, cyan, and yellow and black toner, respectively. The resulting images formed with each color toner are successively superimposed one over the other to form a multicolor image.

Various organic pigments are used as the colorant for each color toner mentioned above, and carbon black is used as the colorant for black toner.

The important factors which determine the characteristics of the carbon black are as follows:

(1) mean grain size;
(2) structure; and
(3) chemical properties of the grain surface.

The mean grain size is a factor which determines the colorability of carbon black, and measured by statistically evaluating an image observed through an electron microscope.

The structure is a term characteristic of carbon black and representing the degree to which carbon black particles are linked with one another. The structure can be relatively easily measured by evaluating the image observed through an electron microscope, and generally determined quantitatively by measuring the specific surface area of carbon black, and the oil absorption of carbon black when dibutyl phthalate is used as an oil.

For example, according to the data issued by Colombian Carbon Co., the conditions of carbon black particles are denoted in the following manner. The condition in which carbon black particles are linked with one another to a high degree is referred to as "high structure", the intermediate degree as "normal structure", and the low degree as "low structure". The degree of linkage is also represented by a structure index. The structure index of carbon black is determined in the following manner. First, the carbon black of normal structure is arbitrarily defined as "100". Then, the structure index of carbon black is determined based on a curve representing the relationship between the specific surface area and the oil absorption when dibutyl phthalate is used as an oil of the carbon black of normal structure (abscissa: specific surface, ordinate: oil absorption when dibutyl phthalate is used as an oil).

The chemical properties of the particle surface are generally determined by the kind and the content of an oxygen-containing component present on the particle surface, and ordinarily determined by the content of a volatile component.

Since conventional carbon black to be added in black toner has a high electrical conductivity unlike other colorants, and is used as a conductivity-imparting agent at is known, the electrical properties of black toner are largely different from those of other color toners.

Since colorants other than carbon black have only the same conductivity as a resin binder, the conductivity of color toner is substantially of the same order as a resin binder alone, while the conductivity of black toner containing carbon black is very much higher than that of the resin binder.

Accordingly, when both black toner and color toner having largely different electrical properties such as conductivity are used together to form images under the same conditions, there arises a difference in the amount of toner to be transferred and the like between the black toner and the color toner, making it impossible to reproduce vivid color images.

In order to overcome the above problem, the conditions for the formation of images may be changed in accordance with black toner and color toner. However, it is necessary to change the conditions whenever an image is formed. This causes the apparatus to operate unstably, thereby adversely affecting formed images, and involving a complicated structure for the apparatus.

SUMMARY OF THE INVENTION

The black toner for electrophotography of this invention, comprises a resin binder, and carbon black dispersed in the resin binder, the carbon black having a volatile component content of 4% or more, a structure index of 100 or more, and a mean grain size in the range of 20 to 35 nm.

The method for forming an image by visualizing an electrostatic latent image formed on an image-holding body of this invention, comprises the steps of:

forming a black image by using black toner for electrophotography comprising a resin binder, and carbon black dispersed in the resin binder, the carbon black having a volatile component content of 4% or more, a structure index of 100 or more, and a mean grain size in the range of 20 to 35 nm; and forming a colored image by using a mixture of magenta, cyan and yellow toner.

Thus, the invention described herein makes possible the advantages of (1) providing black toner for electrophotography which has electrical properties close to those of color toners; and (2) providing black toner for electrophotography which can reproduce vivid color images under the same conditions as those for color toners.

These and other advantages of the present invention will become apparent to those skilled in the art upon reading and understanding the following detailed description with reference to the accompanying figure.

DESCRIPTION OF THE PREFERRED EMBODIMENTS

Figure 1:
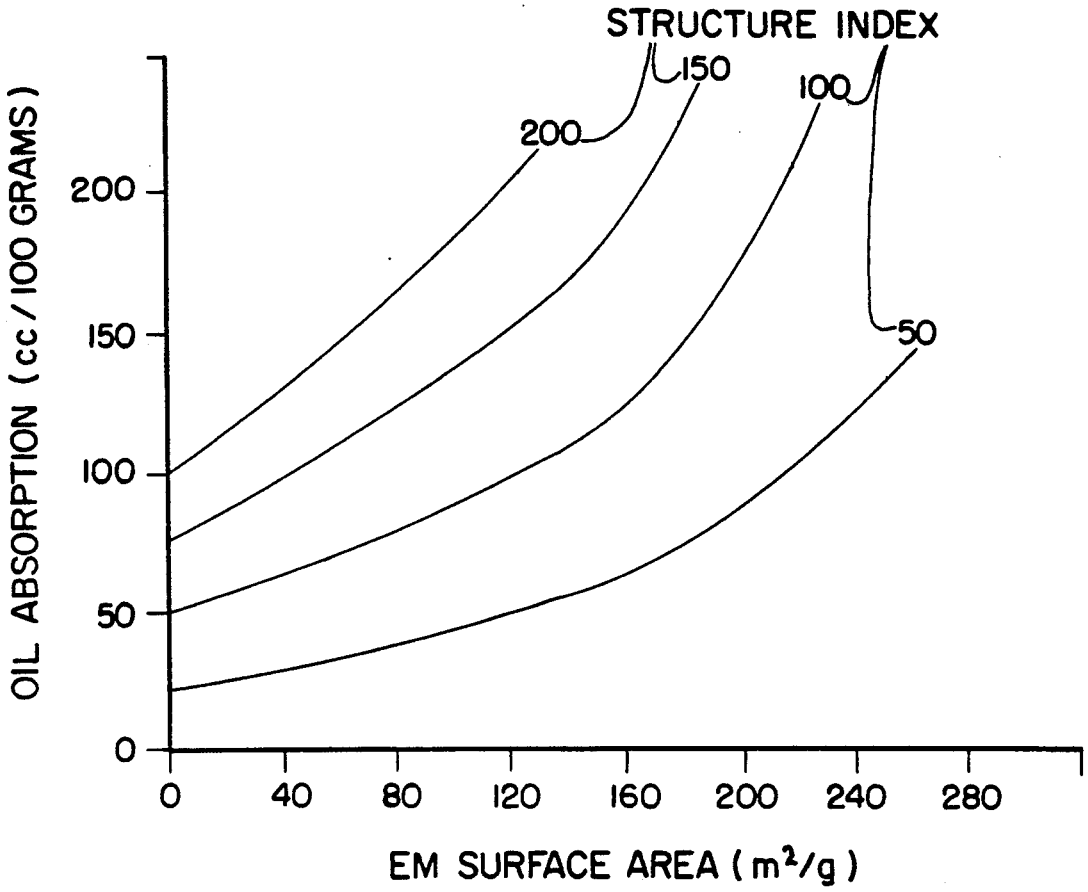
FIG. 1 is a graph showing the relationship between the specific surface area of carbon black and oil absorption thereof.

In the present invention, the content of the volatile component in carbon black is limited to 4% or more for the following reasons.

If the content of the volatile component in carbon black is less than 4%, carbon black has high conductivity, and tends to flocculate, lowering the dispersibility in a resin binder. This causes some carbon black particles to form electrically continuous bodies, resulting in black toner having a conductivity very much higher than that of color toner. On the contrary, if the content of the volatile component in carbon black is 4% or more, the conductivity of carbon black can be decreased and the dispersibility of carbon black in a resin binder can be improved, thereby making the conductivity of black toner close to that of color toner.

The upper limit on the content of the volatile component mentioned above is not particularly restricted in the present invention, and the volatile component can be used in an amount up to the upper limit determined according to the kind of carbon black. The content of the volatile component in carbon black is generally in the range of 4 to 20%, and preferably in the range of 4 to 15%.

The structure index of carbon black is limited to 100 or more for the following reasons.

If the structure index of carbon black is less than 100, carbon black particles tend to flocculate in the same manner as mentioned before, which lowers the dispersibility of carbon black in a resin binder, resulting in black toner having a conductivity very much higher than that of color toner. On the contrary, If the structure index is 100 or more, the dispersibility of carbon black in a resin binder can be improved, making the conductivity of black toner close to that of color toner.

The upper limit on the structure index is not particularly restricted in the present invention, and carbon black of a structure index up to about 200, i.e., conventional upper limit on a structure index, can be used. The structure index of carbon black is preferably in the range of 100 to 170, and more preferably in the range of 100 to 150.

Further, the mean grain size of carbon black is limited within the range of 20 to 35 nm for the following reasons.

If the mean grain size of carbon black is more than 35 nm, it is necessary that a large amount of carbon black is added to provide a satisfactory black hue, resulting in black toner having a conductivity very much higher than that of color toner. On the contrary, if the mean grain size is 35 nm or less, the addition of less carbon black can provide a satisfactory black hue. Therefore, the amount of carbon black to be added can be decreased, making the conductivity of black toner close to that of color toner.

On the other hand, if carbon black has a mean grain size of less than 20 nm, it tends to flocculate, which lowers the dispersibility in a resin binder, resulting in black toner having a conductivity very much higher than that of color toner. On the contrary, if carbon black has a mean grain size of 20 nm or more, the dispersibility in a resin binder can be improved, making the conductivity of black toner close to that of color toner. The mean grain size of carbon black is preferably in the range of 23 to 32 nm.

Carbon black for use in the present invention which has the characteristics mentioned above may be selected from various conventional carbon blacks such as channel black, roller black, disk black, gas furnace black, oil furnace black, thermal black, and acetylene black.

The amount of carbon black to be added is not particularly limited, but less carbon black is preferable to make the conductivity of black toner close to that of color toner. It is preferable that the amount of carbon black to be added is within the range of 3 to 8 parts by weight for every 100 parts by weight of a resin binder.

Examples of the resin binder include styrene polymer (homopolymer or copolymer containing styrene or substituted styrene) such as polystyrene, chloro-polystyrene, poly-α-methylstyrene, styrene-chloro-styrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer (styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylic ester copolymer (styrene-methyl methacrylate copolymer, styrene-ethyl methacrylate copolymer, styrene-butyl methacrylate copolymer, styrene-phenyl methacrylate copolymer, etc.), styrene-α-chlormethyl acrylate copolymer, and styrene-acrylonitrile-acrylic ester copolymer; polyvinyl chloride, low molecular weight polyethylene, low molecular weight polypropylene, ethylene-ethyl acrylate copolymer, polyvinylbutyral, ethylene-vinyl acetate copolymer, rosin modified maleic acid resin, phenol resin, epoxy resin, polyester resin, ionomer resin, polyurethane resin, silicone resin, ketone resin, xylene resin, polyamide resin. These are used alone, or in combination of two or more kinds thereof.

The conductivity of the resin binder is preferably in the range of $1.0\times10^{-9}$ to $5.0\times10^{-9}$ S/cm, and more preferably in the range of $1.5\times10^{-9}$ to $4.0\times10^{-9}$ S/cm.

If the conductivity of the resin binder is less than $1.0\times10^{-9}$ S/cm, it is too low for a resin binder, which may cause an extremely large difference between black toner and color toner in conductivity.

On the other hand, if the conductivity of the resin binder exceeds $5.0\times10^{-9}$ S/cm, charge tends to escape. Therefore, the charge retention characteristics of toner may fluctuate.

In addition to the above two components, for example, a charge control agent and a mold releasing agent (offset inhibitor) and other various additives may be added to the black toner for electrophotography of the present invention.

As the charge control agent, either charge control agents for positive electric charge or negative electric charge are used.

Examples of the charge control agent for positive electric charge include organic compounds having basic nitrogen atoms such as basic dye, aminopyrine, pyrimidine compounds, polynuclear polyamino compounds, aminosilanes, and fillers subjected to surface treatment with the above compounds.

Examples of the charge control agent for negative electric charge include compounds having carboxyl groups such as alkyl salicylate metal chelate, metal complex dye, fatty acid soap, and metallic salts of naphthenate.

The charge control agent is added in the range of 0.1 to 10 parts by weight, preferably in the range of 0.5 to 8 parts by weight for every 100 parts by weight of the resin binder.

Examples of the mold releasing agent (offset inhibitor) include aliphatic hydrocarbon, aliphatic metallic salts, higher fatty acids, fatty acid esters or partially saponified products thereof, silicone oil, and various waxes. Among them, aliphatic hydrocarbon having a weight average molecular weight in the range of 1,000 to 10,000 is preferable. Specifically, suitable are combinations of one or two kinds of low molecular weight polypropylene, low molecular weight polyethylene, paraffin wax, low molecular weight olefin polymer consisting of olefin units each having 4 or more carbon atoms.

The mold releasing agent is preferably used in the range of 0.1 to 10 parts by weight, and more preferably 0.5 to 8 parts by weight for every 100 parts by weight of the resin binder.

The black toner for electrophotography of the present invention can be produced in the following manner. The components mentioned above are uniformly premixed by means of a dry blender, Henschel mixer, ball mill, etc. The resulting mixture is uniformly melted and kneaded by means of a kneading machine such as a Banbury mixer, a roller, or a one- or twin-screw extrusion kneader, after which the kneaded mixture is cooled, ground, and if desired classified. Other than this process, the black toner for electrophotography of the present invention can be produced by suspension polymerization, etc.

The black toner for electrophotography of the present invention preferably has a grain size in the range of 3 to 35 μm, and more preferably in the range of 5 to 25 μm.

The surface of the black toner for electrophotography of the present invention can be sprinkled with a surface treatment agent (fluidization agent), improving the flowability and charge characteristics. Various known materials such as inorganic fine particles and fluorocarbon resin particles can be used as the surface treatment agent. Especially, silica surface treatment agent containing hydrophobic or hydrophilic silica fine particles such as silica anhydride ultrafine particles and colloidal silica are preferably used.

The black toner for electrophotography of the present invention can be used in combination with magnetic carrier such as ferrite or iron powder as two-component developer for various full color or monocolor image forming apparatuses.

The conductivity of the black toner for electrophotography of the present invention is preferably in the range of $4.0\times10^{-10}$ to $6.0\times10^{-9}$ S/cm, and more preferably in the range of $4.5\times10^{-10}$ to $5.0\times10^{-9}$ S/cm.

When the black toner for electrophotography of the present invention is used together with colored toner, the color toner is generally a mixture of magenta, cyan and yellow toner.

The conductivity ratio of the black toner to the color toner (conductivity of the black toner/conductivity of the color toner) is preferably 2.0 or less, and more preferably 1.7 or less.

EXAMPLES

The present invention is described in detail by reference to concrete examples and comparative examples below.

In the following examples, the mean grain size, structure index, and volatile component content of carbon black are measured in accordance with the following methods.

(1) Determination of the mean grain size of carbon black:

Carbon black is photographed with an electron microscope. Grain size is measured with a semiautomatic particle size analyzer TGZ3 (manufactured by Carl Zeiss, Oberkochen). The measured value is represented in nanometers as a mean grain size.

(2) Determination of the structure index of carbon black:

A specific surface area of carbon black and oil absorption thereof in the case where dibutyl phthalate is used as an oil are measured. A structure index of carbon black is obtained from FIG. 1.

In FIG. 1, the specific surface area of carbon black is plotted on the abscissa, and the oil absorption is plotted on the ordinate.

(3) Determination of the volatile component content of carbon black:

Carbon black is placed in a crucible with a 2 mm hole, and is then heated in a muffle furnace for 7 minutes at 950° C. Loss in weight of the carbon black is calculated as a volatile component content.

EXAMPLES 1 AND 2, COMPARATIVE EXAMPLES 1 TO 4

One hundred parts by weight of polyester resin having a conductivity of $2.8\times10^{-10}$ S/cm as a resin binder, 2 parts by weight of zinc compound of salicylate as a charge control agent, and 5 parts by weight of carbon black having characteristics as shown in Table 1 below were mixed, and the mixture was melted and kneaded, after which the kneaded mixture was ground and classified to produce black toners having a mean grain size of 10 μm.

TABLE 1

| | Volatile component (%) | Structure index | Mean particle size (nm) |
|---|---|---|---|
| Example 1 | 6 | 135 | 25 |
| Example 2 | 7 | 125 | 29 |
| Comparative Example 1 | 1.2 | 105 | 23 |
| Comparative Example 2 | 4 | 95 | 26 |
| Comparative Example 3 | 4.5 | 100 | 18 |
| Comparative Example 4 | 6 | 105 | 39 |

REFERENCE EXAMPLE 1

Each color toner of cyan, magenta, and yellow was produced in the same manner as in above Examples 1 and 2, and Comparative Examples 1 to 4, except that phthalocyanine pigment (cyan toner), quinacridone pigment (magenta toner), and benzine pigment (yellow toner) were added each in the same amount in place of the carbon black.

By the use of the black toners obtained in the above examples and comparative examples, and color toners obtained in the reference example, the following tests were conducted.

Measurement of Conductivity

Each of the black toners and color toners thus obtained was filled in a shielding case, after which the sample was applied with a pressure of 20 kg/cm$^2$, adjusted to a thickness of 0.4 mm, and set on an electrode adaptor (electrode for powder SE-43 manufactured by ANDO DENKI Co., Ltd.). Then, the electrode adaptor was connected to an impedance analyzer (4192A LF manufactured by YOKOKAWA Hewlett Packard Co.) to measure the conductivity.

Measurement of the Amount of Development and the Amount of Transfer

Ferrite carrier having a mean grain size of 70 μm was added to 100 parts by weight of toner. The mixture was uniformly blended by stirring to produce two-component developer with a toner concentration of 4%. The resulting developer was used for an electrophotographic copying machine (AC-9500 manufactured by MITA Industrial Co., Ltd.), and the developing conditions for the machine was set so that the amount of color toner used for development may be 120 mg (A3 duty 20%) to conduct the copying process on paper. Then, the amount of toner transferred onto paper and the amount of toner recovered at a cleaning section of the machine were measured. The total amount thereof was recorded as the amount of development (mg), and the amount of toner transferred onto paper was recorded as the amount of transfer (mg).

Measurement of Image Density

Among the transferred images obtained in the above process for measuring the amounts of development and transfer, those formed with the black toners of the above examples and comparative examples were measured for their density by means of a densitometer (manufactured by SAKURA Co., Ltd.).

These results are shown in Table 2 below.

TABLE 2

| | Conductivity (S/cm) | Amount of development (mg) | Amount of transfer (mg) | Image Density |
|---|---|---|---|---|
| Example 1 | $4.8 \times 10^{-10}$ | 135 | 108 | 1.95 |
| Example 2 | $4.7 \times 10^{-10}$ | 136 | 106 | 1.93 |
| Comparative Example 1 | $8.1 \times 10^{-10}$ | 180 | 90 | — |
| Comparative Example 2 | $9.5 \times 10^{-10}$ | 190 | 92 | — |
| Comparative Example 3 | $9.8 \times 10^{-10}$ | 205 | 85 | — |
| Comparative Example 4 | $5.0 \times 10^{-10}$ | 138 | 95 | 1.41 |
| Cyan | $2.9 \times 10^{-10}$ | 120 | 95 | — |
| Magenta | $2.9 \times 10^{-10}$ | 123 | 92 | — |
| Yellow | $3.0 \times 10^{-10}$ | 121 | 94 | — |

Each black toner of Comparative Examples 1 to 3 was compared with the color toners of Reference Example 1. As shown in Table 1, the black toner of Comparative Example 1 contains carbon black having a volatile component content of less than 6%, the black toner of Comparative Example 2 contains carbon black having a structure index of less than 100, and the black toner of Comparative Example 3 contains carbon black having a mean grain size of less than 20 nm. According to Table 2, with every black toner of Comparative Examples 1 to 3, the conductivity is higher, and the amount of development is larger and the amount of transfer is smaller as compared with each color toner containing the same resin binder as that in the black toners under the same developing conditions. These results indicate that no black toner of Comparative Examples 1 to 3 is suitable for use in development under the same developing conditions as those for the color toners. Further, with the black toner of Comparative Example 4, which has a mean grain size of more than 35 nm as shown in Table 1, the image density is extremely low, so that a satisfactory black hue cannot be exhibited.

In contrast, with the black toners of Examples 1 and 2, the conductivity, the amount of development, and the amount of transfer are close to those of the color toners, respectively. Further, the image density is high. These results revealed that the Examples 1 and 2 are suitable for use in development under the same developing conditions as those for color toners containing the same resin binder as that in black toners.

EXAMPLE 3, COMPARATIVE EXAMPLES 5 to 8

One hundred parts by weight of polyester resin having a conductivity of $1.2 \times 10^{-9}$ S/cm as a resin binder, 2 parts by weight of zinc compound of salicylate as a charge control agent, and 5 parts by weight of carbon black having characteristics as shown in Table 3 below were mixed, and the mixture was melted and kneaded, after which the kneaded mixture was ground and classified to produce black toner having a mean grain size of 10 μm.

TABLE 3

| | Volatile component (%) | Structure index | Mean particle size (nm) |
|---|---|---|---|
| Example 3 | 6 | 135 | 25 |
| Comparative Example 5 | 1.2 | 105 | 23 |
| Comparative Example 6 | 4 | 95 | 26 |
| Comparative Example 7 | 4.5 | 100 | 18 |
| Comparative Example 8 | 6 | 105 | 39 |

REFERENCE EXAMPLE 2

Each of cyan, magenta, and yellow toners was produced in the same manner as in Example 3, and Comparative Examples 5 to 8, except that phthalocyanine pigment (cyan toner), quinacridone pigment (magenta toner), and benzine pigment (yellow toner) each in the same amount were added in place of the carbon black.

By the use of the black toners obtained in Example 3, and Comparative Examples 5 to 8, and the color toners obtained in Reference Example 2, each test was conducted for measuring the conductivity, the amount of development, the amount of transfer, and the image density. The results are shown in Table 4 below.

TABLE 4

| | Conductivity (S/cm) | Amount of development (mg) | Amount of transfer (mg) | Image Density |
|---|---|---|---|---|
| Example 3 | $1.6 \times 10^{-9}$ | 124 | 95 | 1.81 |
| Comparative Example 5 | $6.2 \times 10^{-9}$ | 190 | 90 | — |
| Comparative | $6.9 \times 10^{-9}$ | 201 | 92 | — |

TABLE 4-continued

| | Conductivity (S/cm) | Amount of development (mg) | Amount of transfer (mg) | Image Density |
|---|---|---|---|---|
| Example 6 | | | | |
| Comparative Example 7 | $7.1 \times 10^{-9}$ | 205 | 88 | — |
| Comparative Example 8 | $1.8 \times 10^{-9}$ | 138 | 92 | 1.39 |
| Cyan | $1.4 \times 10^{-9}$ | 121 | 96 | — |
| Magenta | $1.3 \times 10^{-9}$ | 123 | 93 | — |
| Yellow | $1.2 \times 10^{-9}$ | 122 | 94 | — |

Each black toner of Comparative Examples 5 to 7 was compared with the color toners of Reference Example 2. As shown in Table 3, the black toner of Comparative Example 5 contains carbon black having a volatile component content of less than 6%, the black toner of Comparative Example 6 contains carbon black having a structure index of less than 100, and the black toner of Comparative Example 7 contains carbon black having a mean grain size of less than 20 nm. According to Table 4, with every black toner of Comparative Examples 5 to 7, the conductivity is higher, and the amount of development is larger and the amount of transfer is smaller as compared with each color toner containing the same resin binder as that in the black toners under the same developing conditions. These results indicate that no black toner of Comparative Examples 5 to 7 is suitable for use in development under the same developing conditions as those for the color toners. Further, with the black toner of Comparative Example 8, which has a mean grain size of more than 35 nm as shown in Table 3, the image density is extremely low, so that a satisfactory black hue cannot be exhibited.

In contrast, with the black toner of Example 3, the conductivity, the amount of development, and the amount of transfer are close to those of the color toners, respectively. Further, the image density is high. These results reveal that the black toner of Example 3 is suitable for use in development under the same developing conditions as those for color toners containing the same resin binder as that in the black toners.

EXAMPLE 4

Black toner having a mean grain size of 10 μm was produced in the same manner as in the above examples and comparative examples, except that 100 parts by weight of polyester resin having a conductivity of $4.8 \times 10^{-9}$ S/cm as a resin binder, and 5 parts by weight of carbon black having a content of 6% volatile component, a structure index of 135, and a mean grain size of 25 nm were used.

REFERENCE EXAMPLE 3

Each of cyan, magenta, and yellow toners was produced in the same manner as in Example 4, except that phthalocyanine pigment (cyan toner), quinacridone pigment (magenta toner), and benzine pigment (yellow toner) each in the same amount were added in place of the carbon black.

By the use of the black toner obtained in Example 4 and the color toners obtained in Reference Example 3, each test was conducted for measuring the conductivity, the amount of development, and the amount of transfer. The results are shown in Table 5 below.

TABLE 5

| | Conductivity (S/cm) | Amount of development (mg) | Amount of transfer (mg) |
|---|---|---|---|
| Example 4 | $5.0 \times 10^{-9}$ | 123 | 93 |
| Cyan | $4.9 \times 10^{-9}$ | 122 | 95 |
| Magenta | $4.8 \times 10^{-9}$ | 124 | 96 |
| Yellow | $4.8 \times 10^{-9}$ | 123 | 95 |

As shown in Table 5, with the black toner of Example 4, the conductivity, the amount of development, and the amount of transfer are close to those of color toner, respectively. Further, the image density is high. These results indicate that the black toner of Example 4 is suitable for use in development under the same developing conditions as those for color toners containing the same resin binder as that in black toners.

EXAMPLE 5

Black toner having a mean grain size of 10 μm was produced in the same manner as in Examples 1 and 2, except that 100 parts by weight of polyester resin having a conductivity of $2.5 \times 10^{-9}$ S/cm as a resin binder, and 5 parts by weight of carbon black having a volatile component content of 6%, a structure index of 135, and a mean grain size of 25 nm were used.

REFERENCE EXAMPLE 4

Each of cyan, magenta, and yellow toners was produced in the same manner as in Example 5, except that phthalocyanine pigment (cyan toner), quinacridone pigment (magenta toner), and benzine pigment (yellow toner) each in the same amount were added in place of the carbon black.

By the use of the black toner obtained in Example 5 and the color toners obtained in Reference Example 4, each test was conducted for measuring the conductivity, the amount of development, and the amount of transfer. The results are shown in Table 6 below.

TABLE 6

| | Conductivity (S/cm) | Amount of development (mg) | Amount of transfer (mg) |
|---|---|---|---|
| Example 5 | $2.8 \times 10^{-9}$ | 123 | 94 |
| Cyan | $2.4 \times 10^{-9}$ | 125 | 96 |
| Magenta | $2.5 \times 10^{-9}$ | 124 | 94 |
| Yellow | $2.6 \times 10^{-9}$ | 124 | 93 |

As shown in Table 6, with the black toner of Example 5, the conductivity, the amount of development, and the amount of transfer are close to those of color toners, respectively. Further, the image density is high. These results reveal that the black toner of Example 5 is suitable for use in development under the same developing conditions as those for color toners containing the same resin binder as that in black toners.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. Black toner for electrophotography used for visualizing an electrostatic latent image formed on an image-holding body together with color toner, the black toner comprising:

a resin binder and carbon black dispersed in the resin binder, the carbon black having a volatile component content of 4% or more, a structure index of 100 or more, and a mean grain size in the range of 20 to 35 nm, wherein the conductivity ratio of the black toner to the color toner is 2.0 or less.

2. Black toner for electrophotography according to claim 1, wherein the resin binder has a conductivity in the range of $1.0\times10^{-9}$ to $5.0\times10^{-9}$ S/cm.

3. Black toner for electrophotography according to claim 1, wherein the carbon black contains a volatile component content in the range of 4 to 20%.

4. Black toner for electrophotography according to claim 1, wherein the carbon black has a structure index in the range of 100 to 170.

5. Black toner for electrophotography according to claim 1, wherein the carbon black has a mean grain size in the range of 23 to 32 nm.

6. Black toner for electrophotography according to claim 1, wherein the carbon black is contained in the range of 3 to 8 parts by weight for every 100 parts by weight of the resin binder.

7. Black toner for electrophotography according to claim 1, wherein the resin binder has a conductivity in the range of $1.5\times10^{-9}$ to $4.0\times10^{-9}$ S/cm.

8. Black toner for electrophotography according to claim 1, having a conductivity in the range of $4.0\times10^{-10}$ to $6.0\times10^{-9}$ S/cm.

9. Black toner for electrophotography according to claim 1, having a conductivity in the range of $4.5\times10^{-10}$ to $5.0\times10^{-9}$ S/cm.

10. Black toner for electrophotography according to claim 1 wherein the color toner is a mixture of magenta, cyan and yellow toner.

11. A method for forming an image by visualizing an electrostatic image formed on an image-holding body, comprising the steps of:

forming a black image by using black toner for electrophotography comprising a resin binder, and carbon black dispersed in the resin binder, the carbon black having a volatile component content of 4% or more, the structure index of 100 or more, and a mean grain size in the range of 20 to 35 nm; and forming a colored image by using a mixture of magenta, cyan and yellow toner, wherein the conductivity ratio of the black toner to each magenta, cyan and yellow toner is 2.0 or less.

12. A method for forming an image according to claim 11, wherein the black image and the colored image are superimposed one over the other.

13. A composition comprising at least one resin binder, and carbon black dispersed in said resin binder, the carbon black having a volatile component content of about 4% or more, a structure index of about 100 or more, and a mean grain size in the range of about 20 to about 35 nm.

14. Black toner for electrophotography according to claim 1, wherein the conductivity ratio of the black toner to the color toner is 1.7 or less.

* * * * *